US005706975A

United States Patent [19]

Cronk

[11] Patent Number: 5,706,975

[45] Date of Patent: Jan. 13, 1998

[54] HUGGY CIGARETTE HOLDER

[76] Inventor: Katherine L. Cronk, 2051 S. Hampton Rd., Jacksonville, Fla. 32247

[21] Appl. No.: 753,204

[22] Filed: Nov. 21, 1996

[51] Int. Cl.[6] ..... B65D 85/10

[52] U.S. Cl. ..... 220/737; 220/741; 220/903; 206/88

[58] Field of Search ..... 220/737, 741, 220/903; 206/86, 87

[56] References Cited

U.S. PATENT DOCUMENTS

| | | | |
|---|---|---|---|
| 1,521,951 | 1/1925 | Hill | 206/86 |
| 4,303,154 | 12/1981 | Hicks | 206/86 |
| 4,491,220 | 1/1985 | Daviss | 220/737 |
| 4,588,076 | 5/1986 | Caputo et al. | 206/86 |
| 4,852,729 | 8/1989 | Conte | 206/86 |
| 5,115,940 | 5/1992 | Friedman | 220/737 |

*Primary Examiner*—Joseph M. Moy

[57] ABSTRACT

A huggy cigarette holder device that includes a first holder body. The first holder body has a top opening, a bottom wall with a substantially cylindrical continuous side wall. The cylinder side wall is sized for receiving a container filled with a beverage. A second holder body is attached to the first holder body. The second holder body has a substantially cylindrical continuous wall defining a central opening for receiving a container filled with a combustible fluid. Lastly, a third holder body is included. The third holder body has an upper opening, a lower wall and a substantially rectangular side wall with a front face and a pair of side faces. The pair of side faces and the lower wall of the third holder body is integral the cylindrical side wall of the first holder body. At least one of the side faces is adjacent the second holder body. The third holder body is sized for receiving a standard pack of cigarettes.

1 Claim, 2 Drawing Sheets

HUGGY CIGARETTE HOLDER

BACKGROUND OF THE INVENTION

1. Field of the Invention

The present invention relates to a huggy cigarette holder and more particularly pertains to providing interconnected holders of varying shapes and sizes that will hold a beverage container, a pack of cigarettes and a cigarette lighter simultaneously.

2. Description of the Prior Art

The use of a beverage holder and cigarette holder is known in the prior art. More specifically, beverage holders and cigarette holders heretofore devised and utilized for the purpose of individually holding a beverage or a pack of cigarettes are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,259,529 to Coale discloses a collapsible insulated receptacle for beverage containers. U.S. Pat. No. 5,211,307 to Jeffries discloses an insulated container holder. U.S. Pat. No. Des. 306,937 to Charet and Kraai discloses a combined cigarette and lighter holder, beverage holder and tray for an automobile dash. U.S. Pat. No. 4,852,729 to Conte discloses a cigarette-lighter holder. U.S. Pat. No. 4,401,245 to Zills discloses a collapsible, insulative beverage container carrier. Lastly, U.S. Pat. No. 4,282,279 to Strickland discloses a formable removable insulating enclosure for a container.

While these devices fulfill their respective, particular objectives and requirements, the aforementioned patents do not describe Huggy cigarette holder that allows the same container that insulates and carries the beverage to hold the cigarette pack and lighter safely and conveniently.

In this respect, the huggy cigarette holder according to the present invention substantially departs from the conventional concepts and designs of the prior art, and in doing so provides an apparatus primarily developed for the purpose of providing interconnected holders of varying shapes and sizes that will hold a beverage container, a pack of cigarettes and a cigarette lighter simultaneously.

Therefore, it can be appreciated that there exists a continuing need for a new and improved huggy cigarette holder which can be used for providing interconnected holders of varying shapes and sizes that will hold a beverage container, a pack of cigarettes and a cigarette lighter simultaneously. In this regard, the present invention substantially fulfills this need.

SUMMARY OF THE INVENTION

In view of the foregoing disadvantages inherent in the known types of beverage holders and cigarette holders now present in the prior art, the present invention provides an improved Huggy cigarette holder. As such, the general purpose of the present invention, which will be described subsequently in greater detail, is to provide a new and improved huggy cigarette holder and method which has all the advantages of the prior art and none of the disadvantages.

To attain this, the present invention essentially comprises a first holder body of resilient material having a top opening, a bottom wall and a substantially cylindrical continuous side wall extending from the bottom wall. The cylindrical side wall of the holder body has an interior surface defining a central opening extending from the open top to the bottom wall. The central opening is sized for receiving a container filled with a beverage. The cylindrical side wall of the holder body has an exterior surface. A second holder body of resilient material has a substantially cylindrical continuous wall which defines a central opening. The second holder body is fixedly attached to the exterior surface of the side wall of the first holder body. The second holder body is ⅓ the size of the first holder body to receive a container filled with a combustible fluid. A third holder body of resilient material has an upper opening. A lower wall and a substantially rectangular side wall extend from the lower wall. The rectangular side wall has a front face and a pair of side faces. The pair of side faces and the lower wall of the third holder body are integral the exterior surface of the first holder body. At least one of the side faces is adjacent the second holder body. The rectangular side wall defines a central opening. The central opening of the third holder body has a rigid box-like housing positioned therein for strengthening of the rectangular side wall. The box-like housing is sized to receive a standard pack of cigarettes and a cigarette lighter simultaneously. The front face of the rectangular side wall has a pile-type fastener affixed. Lastly, an L-shaped flap of resilient material has a first end interconnected to the cylindrical side wall of the first holder body for positioning over the upper opening of the third holder body. The flap has a second end with a pile-type fastener to couple with the pile type fastener of the front face of the third holder body. The flap closes the upper opening of the third holder body when coupled to the front face of the third holder body.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved huggy cigarette holder which has all of the advantages of the prior art beverage holders and cigarette holders and none of the disadvantages.

It is another object of the present invention to provide a new and improved huggy cigarette holder which may be easily and efficiently manufactured and marketed.

It is further object of the present invention to provide a new and improved huggy cigarette holder which is of durable and reliable constructions.

An even further object of the present invention is to provide a new and improved huggy cigarette holder which is susceptible of a low cost of manufacture with regard to both materials and labor, and which accordingly is then susceptible of low prices of sale to the consuming public, thereby making such huggy cigarette holder economically available to the buying public.

Even still another object of the present invention is to provide a huggy cigarette holder for providing interconnected holders of varying shapes and sizes that will hold a beverage container, a pack of cigarettes and a cigarette lighter simultaneously.

Lastly, it is an object of the present invention to provide a new and improved huggy cigarette holder device that includes a first holder body. The firs holder body has a top opening, a bottom wall with a substantially cylindrical continuous side wall. The cylinder side wall is sized for receiving a container filled with a beverage. A second holder body is attached to the first holder body. The second holder body has a substantially cylindrical continuous wall defining a central opening for receiving a container filled with a combustible fluid. Lastly, a third holder body is included. The third holder body has an upper opening, a lower wall and a substantially rectangular side wall with a front face and a pair of side faces. The pair of side faces and the lower wall of the third holder body is integral the cylindrical side wall of the first holder body. At least one of the side faces is adjacent the second holder body. The third holder body being is sized for receiving a standard pack of cigarettes and a cigarette lighter simultaneously.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
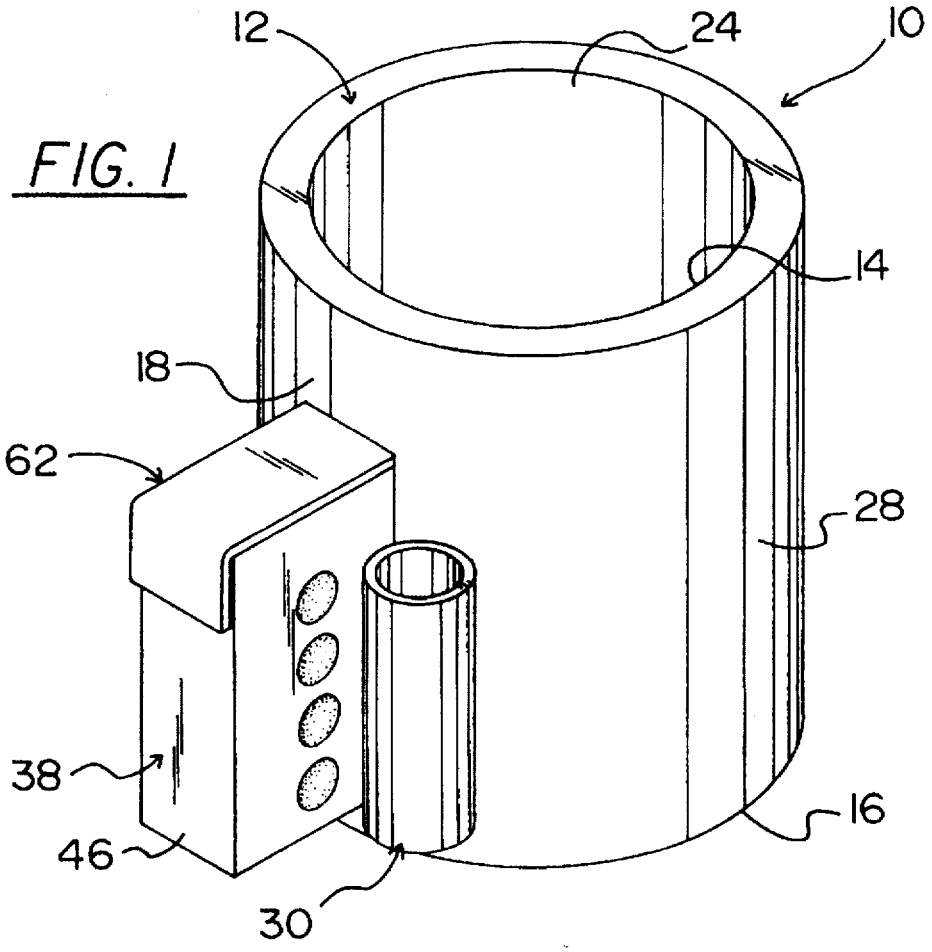
FIG. 1 is a perspective view of the preferred embodiment of the huggy cigarette holder constructed in accordance with the principles of the present invention.

With reference now to the drawings, and in particular to FIG. 1 thereof, the preferred embodiment of the new and improved huggy cigarette holder embodying the principles and concepts of the present invention and generally designated by the reference numeral 10 will be described.

The present invention, the huggy cigarette holder 10 is comprised of a plurality of components. Such components in their broadest context include a first holder body, a second holder body, a third holder body and a flap. Such components are individually configured and correlated with respect to each other so as to attain the desired objective.

Specifically, the present invention includes a first holder body 12 of resilient material. The first holder body has an opening 14, a bottom wall 16 and a substantially cylindrical continuous side wall 18 extending from the bottom wall. The cylindrical side wall of the holder body has an interior surface 24 that defines a central opening. The central opening extends from the open top to the bottom wall of the first holder body. The central opening 26 is sized for receiving a container filled with a beverage. As shown in FIG. 1, the cylindrical side wall of the holder body has an exterior surface 28.

Figure 2:
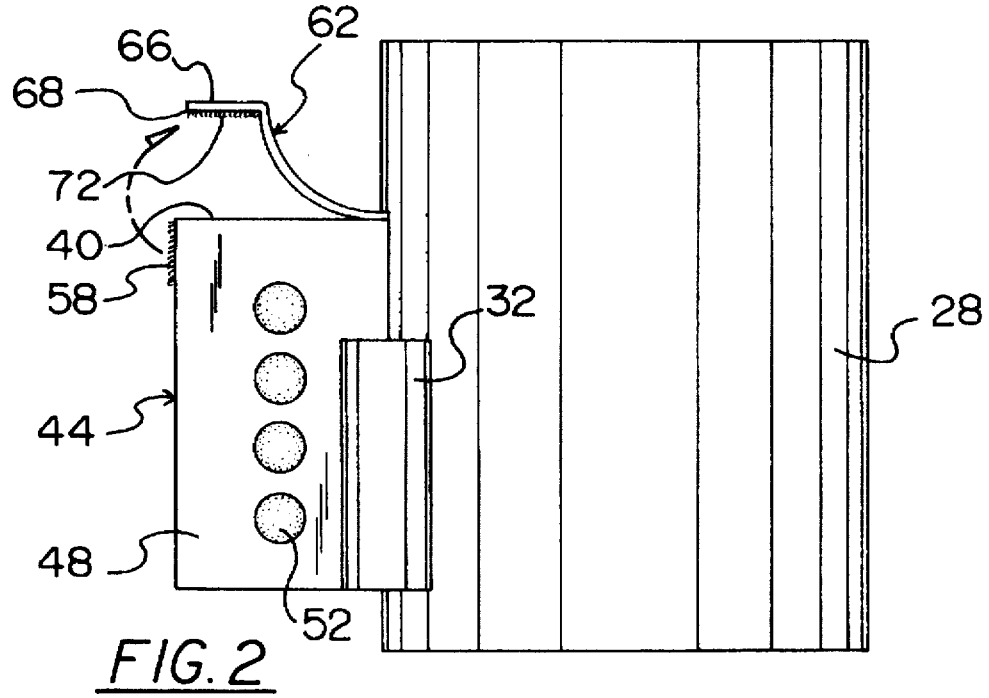
FIG. 2 is a side elevational view of the present invention of FIG. 1 showing the flap in the operable orientation.
Figure 3:
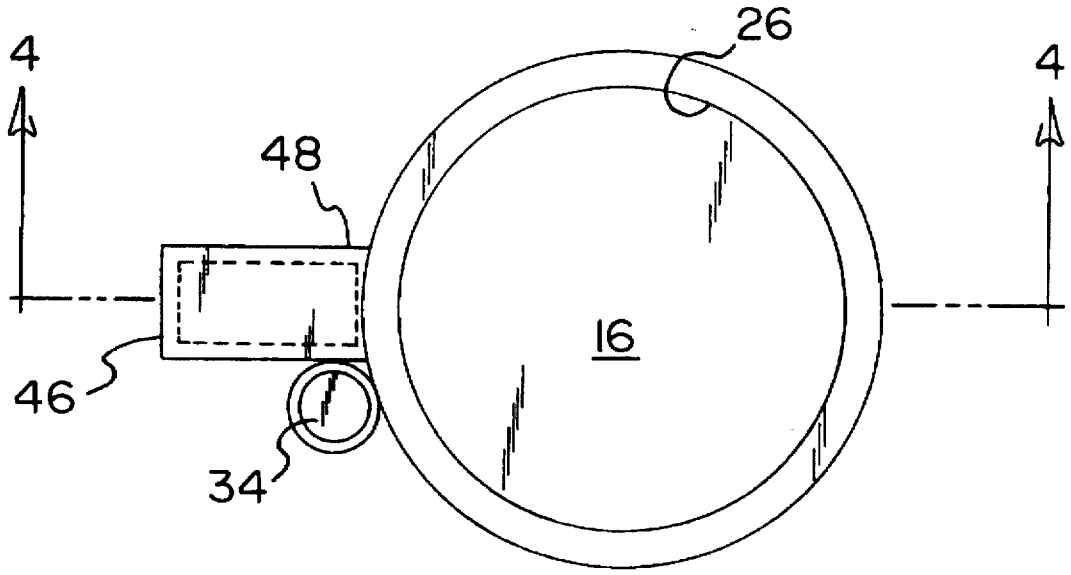
FIG. 3 is a top plan view of the present invention of FIG. 1.

Also, a second holder body 30 of resilient material is provided. The second holder body has a substantially cylindrical continuous wall 32 that defines a central opening 34. As illustrated in FIG. 3, the second holder body is fixedly attached to the exterior surface of the side wall of the first holder body. The second holder body, as seen in FIG. 2, is about ⅓ the size of the first holder body for receiving a container filled with a combustible fluid, commercially known as a cigarette lighter.

Figure 4:
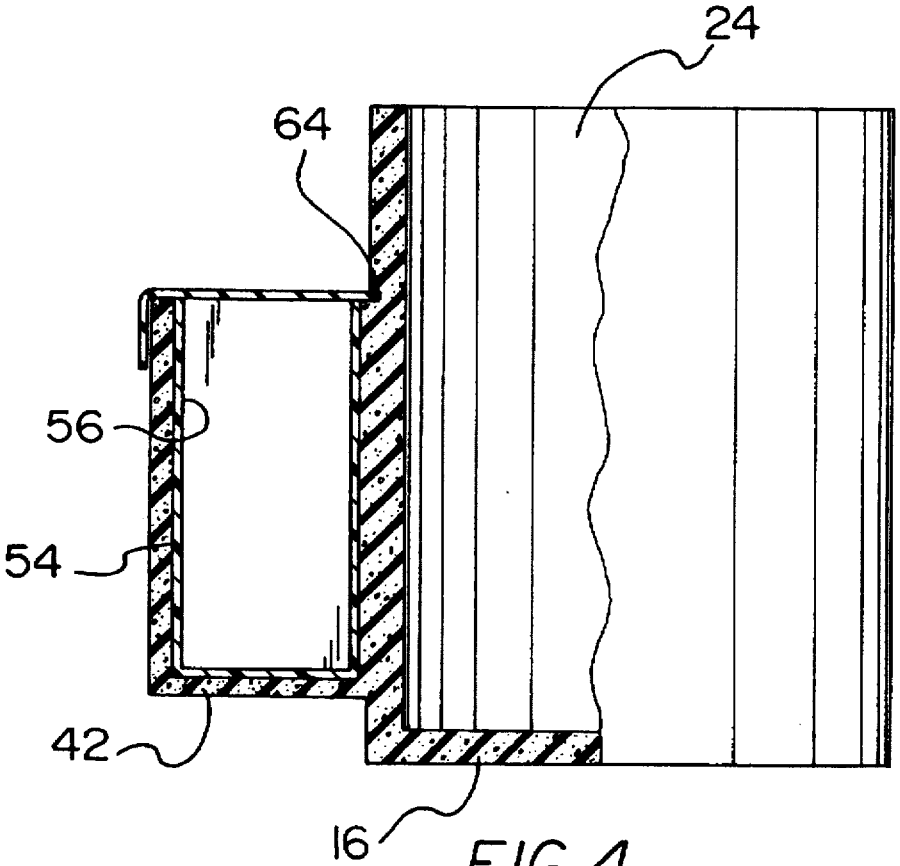
FIG. 4 is a cross-sectional view of the present invention take along line 4—4 of FIG. 3.

Additionally, a third holder body 38 of resilient material is included. The third holder body has an upper opening 40, a lower wall 42 and a substantially rectangular side wall 44 that extends from the lower wall. The rectangular side wall has a front face 46 and a pair of side faces 48. As shown in FIG. 4, the pair of side faces and the lower wall of the third holder body are integral the exterior surface of the first holder body. At least one of the side faces is adjacent the second holder body. Each of the pair of side faces has a plurality of finger grips 52. The plurality of finger grips are recesses formed in the side faces of the third holder body. FIGS. 1 and 2 show the finger grips as they appear on one of the side faces.

As best illustrated in FIG. 3, the rectangular side wall defines a central opening 54. The central opening of the third holder body has a rigid box-like housing 56 positioned within for strengthening of the rectangular side wall. The box-like housing is preferably made from plastic and is one piece having five sides. One of the sides of the box-like housing is adjacent the exterior surface of the first holder body. The box-like housing is sized for receiving a standard pack of cigarettes. The front face 46 of the rectangular side wall has a pile-type fastener 58 affixed to it.

Lastly, an L-shaped flap 62 of resilient material is provided. As depicted in FIG. 3, the flap has a first end 64 that is interconnected to the cylindrical side wall of the first holder body 12. The flap is in this position for placement over the upper opening 40 of the third holder body. The flap has a second end 66 with a pile-type fastener 68 attached to the underside 72 of the flap. The pile-type fastener of the flap couples with the pile type fastener of the front face of the third holder body when the flap is positioned over the upper opening. The flap closes the upper opening of the third holder body when coupled to the front face of the third holder body. The L-shaped flap is easily lowered up and down with respect to the upper opening.

The present huggy cigarette holder device is an insulated beverage can holder that will keep your cigarette pack and lighter conveniently at hand. The resilient material used in forming the first, second and third holder body is a high-density foam that is currently available in the market place. The third holder body of the present invention has the rigid box-like housing in it to protect the cigarette pack from damage when the beverage portion is being used. Because the second holder body is formed of the same resilient materials as the other, it is capable of holding a container filled with combustible fluid that has any shape or size. The container filled with combustible fluid is commercially called a cigarette lighter.

The huggy cigarette holder device of the present invention may be offered in a variety of colors or patterns and can have imprinted slogans or humorous sayings on the exterior surface. Finally, the Huggy cigarette holder device is easily used by an individual. The device will keep drinks cool for longer periods of time while preventing the sweat from the container dripping on a receiving surface. Also, the first holder body which holds the beverage container will protect the cigarettes from water and from being crushed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved huggy cigarette holder device comprising in combination:

a first holder body of resilient material having a top opening, a bottom wall and a substantially cylindrical continuous side wall extending from the bottom wall, the cylindrical side wall of the holder body having an interior surface defining a central opening extending from the open top to the bottom wall, the central opening being sized for receiving a container filled with a beverage, the cylindrical side wall of the holder body having an exterior surface;

a second holder body of resilient material having a substantially cylindrical continuous wall defining a central opening, the second holder body being fixedly attached to the exterior surface of the side wall of the first holder body, the second holder body being ⅓ the size of the first holder body for receiving a container filled with a combustible fluid; and a third holder body of resilient material having an upper opening, a lower wall and a substantially rectangular side wall extending from the lower wall, the rectangular side wall having a front face and a pair of side faces, the pair of side faces and the lower wall of the third holder body being integral the exterior surface of the first holder body, at least one of the side faces being adjacent the second holder body, each of the pair of side faces having a plurality of finger grips being recesses formed therein;

the rectangular side wall defining a central opening, the central opening of the third holder body having a rigid box-like housing being positioned therein for strengthening of the rectangular side wall, the box-like housing being sized for receiving a standard pack of cigarettes therein, the front face of the rectangular side wall having a pile-type fastener being affixed thereto; and an L-shaped flap of resilient material having a first end being interconnected to the cylindrical side wall of the first holder body for positioning over the upper opening of the third holder body, the flap having a second end with a pile-type fastener for coupling with the pile type fastener of the front face of the third holder body, the flap closing the upper opening of the third holder body when coupled to the front face of the third holder body.

* * * * *